US009982424B1

(12) United States Patent
Kuo et al.

(10) Patent No.: US 9,982,424 B1
(45) Date of Patent: May 29, 2018

(54) ENGAGING DEVICE FOR OVERFLOW ASSEMBLY

(71) Applicants: Kuang-Ming Kuo, New Taipei (TW); BRIDGING PARTNERS CORPORATION, Taipei (TW)

(72) Inventors: Kuang-Ming Kuo, New Taipei (TW); Chih-Wei Chen, Changhua (TW)

(73) Assignees: Kuang-Ming Kuo, New Taipei (TW); Bridging Partners Corporation, Taipei (TW)

( * ) Notice: Subject to any disclaimer, the term of this patent is extended or adjusted under 35 U.S.C. 154(b) by 0 days. days.

(21) Appl. No.: 15/494,712

(22) Filed: Apr. 24, 2017

(30) Foreign Application Priority Data

Mar. 30, 2017 (TW) ..... 106204440 U

(51) Int. Cl.
*A47K 11/04* (2006.01)
*E03C 1/24* (2006.01)

(52) U.S. Cl.
CPC ..... *E03C 1/24* (2013.01)

(58) Field of Classification Search
CPC .. E03C 1/24; E03C 1/232; F16L 19/00; F16L 37/00; F16L 37/107; F16L 37/113; F16L 37/24; F16L 37/248
USPC ..... 4/679, 680
See application file for complete search history.

(56) References Cited

U.S. PATENT DOCUMENTS 1,845,882 A * 2/1932 Litschge ..... F16L 37/107 220/293
4,708,370 A * 11/1987 Todd ..... F16L 25/0045 277/615
5,025,509 A * 6/1991 Holt ..... E03C 1/24 4/694
5,466,020 A * 11/1995 Page ..... F16L 37/252 215/332
6,637,050 B1 * 10/2003 Ball ..... E03C 1/24 138/89
7,237,280 B1 * 7/2007 Holden, Jr. ..... E03C 1/24 4/680
2003/0000012 A1 * 1/2003 Ball ..... A01C 11/003 4/680
2003/0151251 A1 * 8/2003 Barnoff ..... F16L 37/248 285/123.15
2011/0000014 A1 * 1/2011 Ball ..... E03C 1/2304 4/679
2013/0042407 A1 * 2/2013 Marotz ..... E03C 1/2304 4/679

(Continued)

*Primary Examiner* — Benjamin R Shaw
(74) *Attorney, Agent, or Firm* — Rosenberg, Klein & Lee

(57) ABSTRACT

An overflow assembly includes an overflow pipe having a mounting end. Multiple engaging portions are defined in the outer periphery of the mounting end. Each engaging portion has an opening and a toothed section. The opening opens to the distal end of the mounting end and communicates with an L-shaped path. The toothed section is defined in one of insides of the path. A collar is rotatably mounted to the mounting end and a protrusion extends radially and inward from the inner periphery of the collar so as to be engaged with the toothed section. The collar is rotated by engaging the protrusion with the toothed section and contacts against the bathtub's wall. An O-ring is axially mounted to the collar. A cap having an overflow aperture is mounted to the collar. The collar is cooperated with the toothed section and no threads are needed.

4 Claims, 8 Drawing Sheets

(56) References Cited

U.S. PATENT DOCUMENTS

| | | | | |
|---|---|---|---|---|
| 2015/0089736 | A1* | 4/2015 | Bird | E03C 1/22 4/680 |
| 2015/0121617 | A1* | 5/2015 | Ball | E03C 1/24 4/680 |

* cited by examiner

ENGAGING DEVICE FOR OVERFLOW ASSEMBLY

BACKGROUND OF THE INVENTION

1. Fields of the Invention

The present invention relates to an overflow assembly, and more particularly, to an overflow assembly without using threads.

2. Descriptions of Related Art

The conventional an overflow port comprising a one-piece overflow fitting comprising an overflow pipe with an inverted L-shape having an elbow portion defining an upper end portion and a lower end portion. The upper end portion has an outer end defining an inlet being adapted to fit through the bathtub overflow port. Threads are formed on an outer surface of the upper end portion and surround the inlet and normally extend through the bathtub overflow port. A lip extends radially outwardly from an outer surface of the overflow pipe between the elbow portion and the upper end portion and is spaced from the inlet to engage an outer surface of the bathtub end wall around the bathtub overflow port. A thin diaphragm is sealed to the outer end of the upper end portion to close the inlet to fluid flow. A nut element is compatible with the threads wherein the nut element has a threaded portion for threadibly mounting the nut to the upper end portion to clamp the overflow fitting to the end of the bathtub between the lip and the nut element. At least one lug extends radially from the nut. A cap is detachably encased to the lug and covering the nut. However, the nut element is compatible with the threads wherein the nut element has a threaded portion for threadibly mounting the nut to the upper end portion to clamp the overflow fitting to the end of the bathtub between the lip and the nut element. The threads are made of metal material and when the two parts with the threads are moved relative to each other, the forward from the threading action may push the overflow pipe inward. There is no proper stop design to stop the overflow pipe to move inward. The movement of the overflow pipe causes the threading area to be reduced and this may cause the overflow pipe shake and shift.

Another improved design uses an adapter which includes multiple stepped outer portions, the adapter is mounted to the head of the overflow pipe, and the cap is mounted to the outside of the adapter. There are no threads involved in the design. However, the inner periphery of the overflow pipe has a protrusion extending inward therefrom, and a threaded hole is defined in the protrusion. Nevertheless, the manufacturing cost for making the protrusion in the inner periphery of the overflow pipe, and for making a threaded hole in the protrusion having a threaded hole is high.

The present invention intends to provide an overflow assembly that does not have threads so as to eliminate the shortcomings mentioned above.

SUMMARY OF THE INVENTION

The present invention relates to an overflow assembly and comprises an overflow pipe having a mounting end. A flange extends outward from the outer periphery of the mounting end of the overflow pipe. A cushion member is mounted to the mounting end and clamped between the flange and the wall of a bathtub. The mounting end extends beyond the inside of the wall of the bathtub. Multiple engaging portions are defined in the outer periphery of the mounting end. Each engaging portion has an opening and a toothed section which has multiple teeth. The opening opens to the distal end of the mounting end and communicates with an L-shaped path which has an even width and turns an angle. The path has a first inside and a second inside which is located closer than the first inside to the distal end of the mounting end. The toothed section is defined in the second inside of the path. The width between the respective tips of the teeth and the first inside of the path is gradually reduced from the opening toward a close end of the path. A collar is rotatably mounted to the mounting end and has an inner periphery from which a protrusion extends. The protrusion is capable of passing through the opening and engaged with the teeth. An O-ring is axially mounted to the collar. A cap is mounted to the outer surface of the collar and the O-ring. The cap has an overflow aperture.

The advantages of the present invention are that the present invention does not need threads to connect the collar and the mounting end of the overflow pipe. The cushion member is positioned by contacting against the flange and absorbs shocks and vibration when the collar is rotatably connected to the overflow pipe, therefore, the overflow pipe is not pushed backed when being installed.

The mounting end includes the engaging portions and the collar has a protrusion which is engaged with the teeth of one of the engaging portions. The width between the tips of the teeth of the engaging portions and the first inside of the path of each of the engaging portions is varied so as to be fit to the different thicknesses of walls of the bathtubs to ensure that the collar contacts against the bathtub's wall. The overflow pipe is well positioned and better than the conventional overflow assembly using threads.

The engaging portions are defined in the outer periphery of the mounting end, not located at the inner periphery of the mounting end so that the manufacturing processes for the overflow pipes are easy and the manufacturing cost is lowered.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
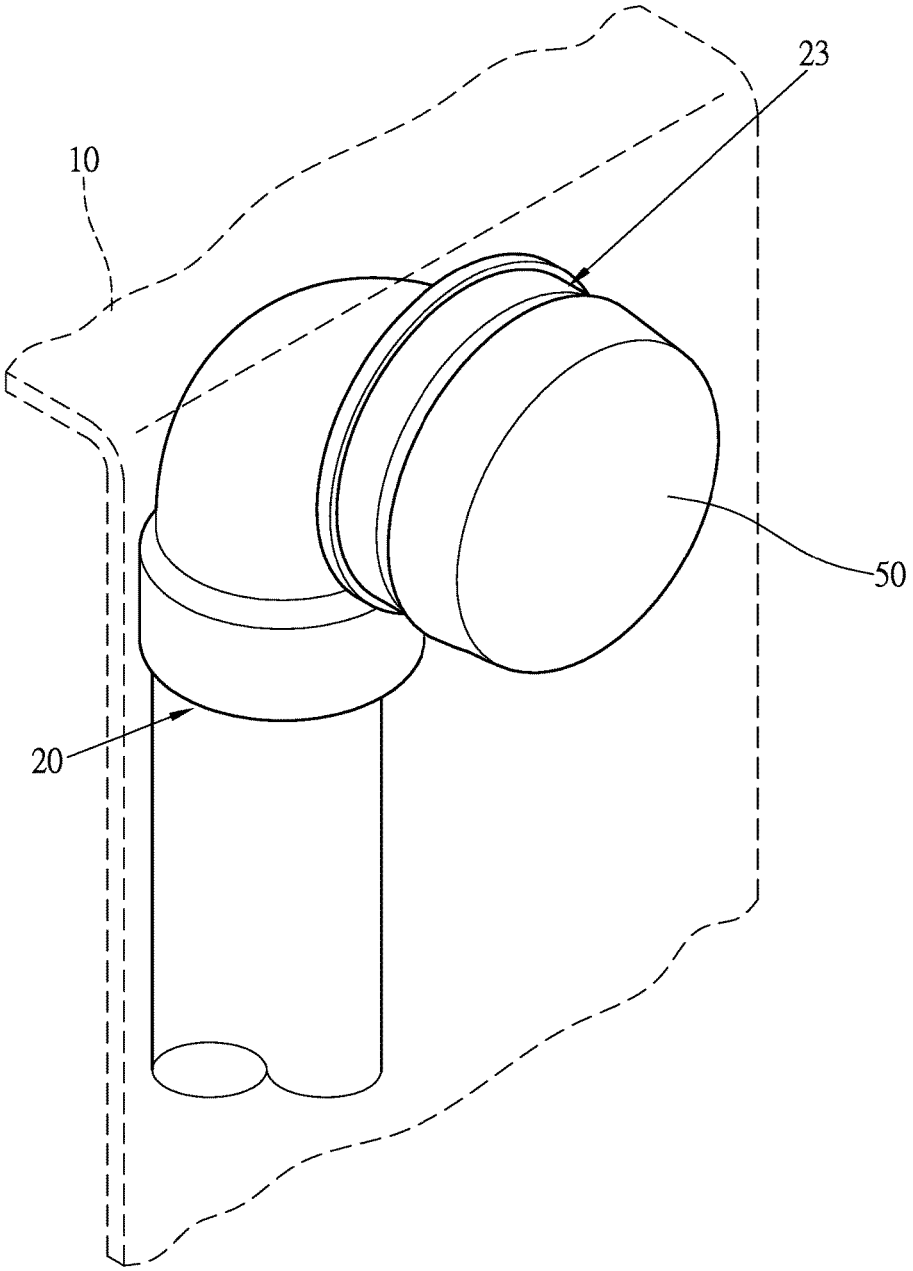
FIG. 1 is a perspective view to show the overflow assembly of the present invention.
Figure 2:
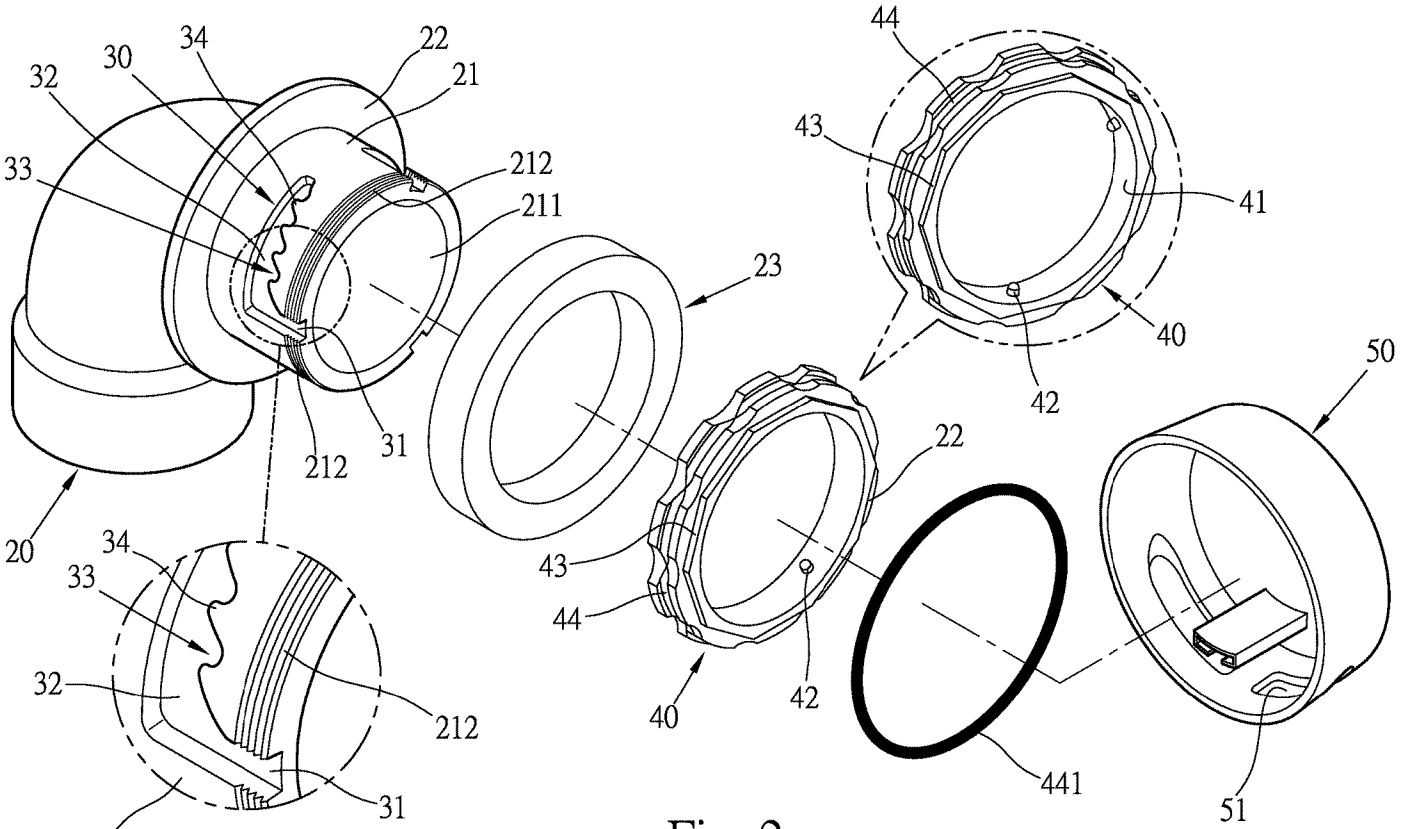
FIG. 2 is an exploded view of the overflow assembly of the present invention.
Figure 3:
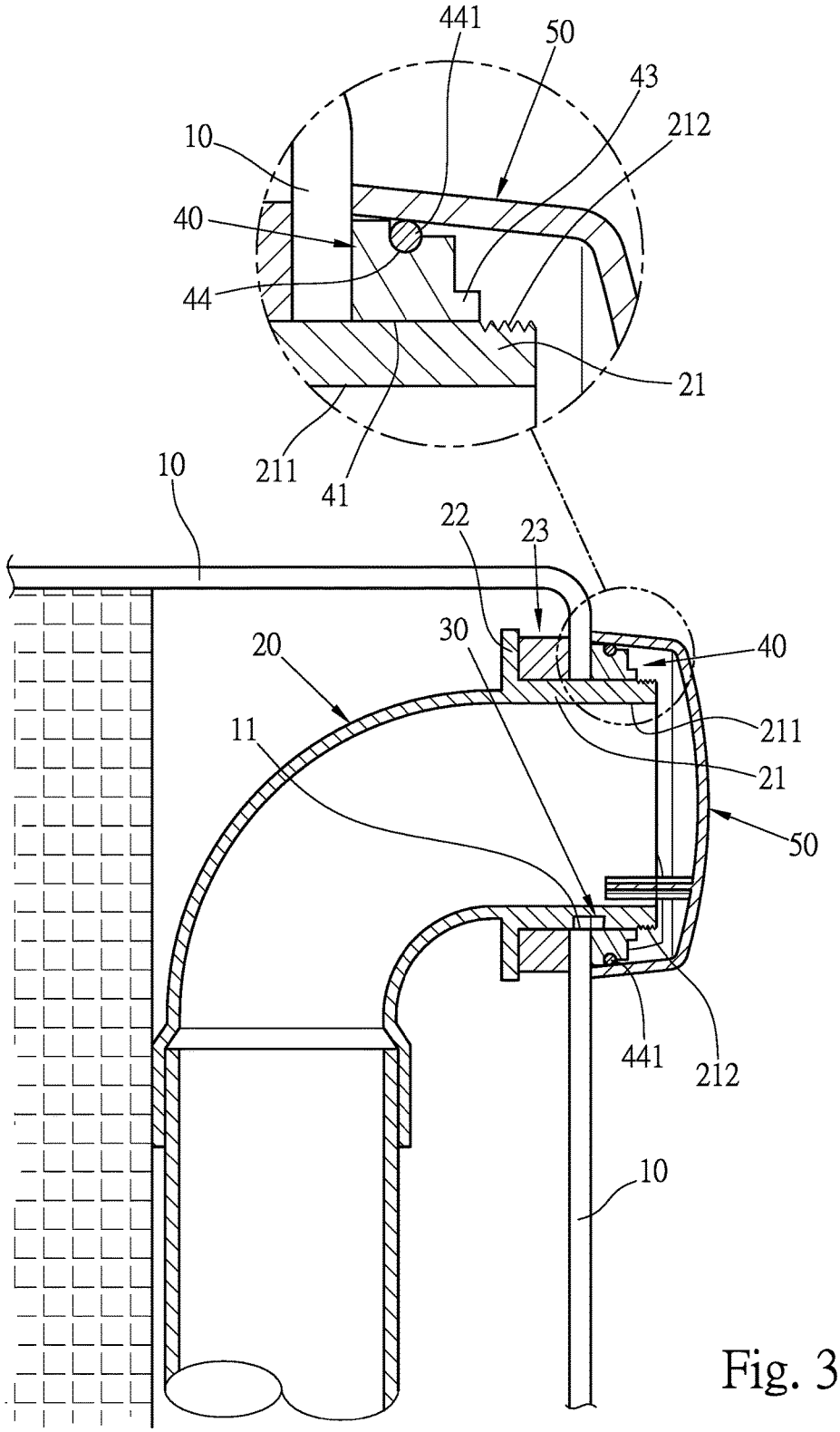
FIG. 3 is a cross sectional view of the overflow assembly of the present invention.

Referring to FIGS. 1 to 3, bathtub 10 has an overflow pipe 20 installed at a proper height thereof. The overflow assembly of the present invention comprises overflow pipe 20, a cushion member 23, a collar 40 and a cap 50. The overflow pipe 20 includes a mounting end 21, and the collar 40 is connected to the mounting end 21 of the overflow pipe 20 by being engaged with one of the engaging portions 30 defined in the mounting end 21 without using threads.

The mounting end 21 horizontally extends beyond the inside of the wall of the bathtub 10, and a passage 211 is defined through the distal end of the mounting end 21 and the overflow pipe 20. The mounting end 21 includes test threads 212 defined in the outer periphery of the mounting end 21. A flange 22 extends outward from the outer periphery of the mounting end 21 of the overflow pipe 20. The outer diameter of the flange 22 is larger than that of the mounting end 21. The cushion member 23 is mounted to the mounting end 21, and the outer diameter of the cushion member 23 is smaller than the outer diameter of the flange 22. The cushion member 23 is clamped between the flange 22 and the wall of the bathtub 10. The cushion member 23 is positioned by contacting against the flange 22 and absorbs shocks and vibration when the collar 40 is rotatably connected to the overflow pipe 20. Therefore, the overflow pipe 20 is not pushed backed when being installed.

The multiple engaging portions 30 are defined in the outer periphery of the mounting end 21 extending beyond the inside of the wall of the bathtub 10, and the engaging portions 30 are equally spaced apart from each other. Each engaging portion 30 has an opening 31 and a toothed section 33. The opening 31 opens to the distal end of the mounting end 21 and communicates with an L-shaped path 32 which has an even width and turns an angle. The direction that the path 32 turns of the engaging portions 30 is the same. The path 32 includes a first inside and a second inside which is located closer than the first inside to the distal end of the mounting end 21. The toothed section 33 is defined in the second inside of the path 32 and has multiple teeth 34. The width between respective tips of the teeth 34 and the first inside of the path 32 is gradually reduced from the opening 31 toward the close end of the path 32.

The collar 40 is rotatably mounted to the mounting end 21 and has an inner periphery 41, wherein a protrusion 42 extends radially and inward from the inner periphery 41 of the collar 40. The height of the protrusion 42 allows the protrusion 42 to pass through the opening 31 and engaged with the teeth 34. The collar 40 includes a driving portion 43 defined in the outer periphery thereof. The driving portion 43 is adapted to be secured by a tool. A groove 44 defined in the outer periphery of the collar 40. An O-ring 441 is axially mounted to the collar 40 and is engaged with the groove 44.

The cap 50 mounted to the outer surface of the collar 40 and the O-ring 441. The cap 50 contacts the O-ring 441 such that the cap 50 is not easily separated from the collar 40. The cap 50 has an overflow aperture 51 so that water will drain through the overflow aperture 51 and the overflow aperture 51 communicates with the passage 211 of the overflow pipe 20.

When assembling, the cushion member 23 is mounted to the mounting end 21 and contacts the flange 22. The mounting end 21 horizontally extends through the installation hole 11 of the bathtub 10, and the mounting end 21 extends beyond the inside of the wall of the bathtub 10. The cushion member 23 is clamped between the flange 22 and the wall of the bathtub 10. The engaging portions 30 and the test threads 212 are exposed beyond the bathtub 10.

Figure 4:
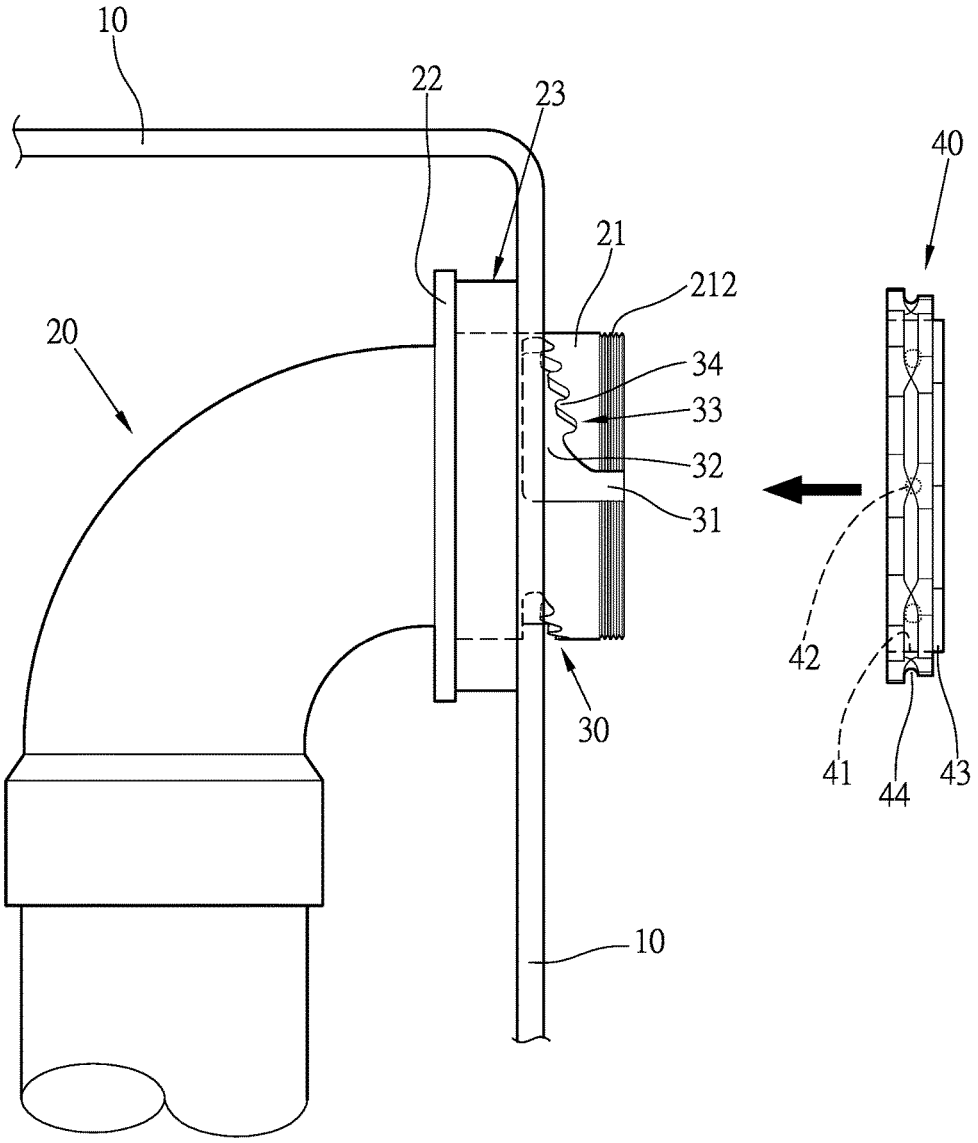
FIG. 4 illustrates that the collar is to be connected to the mounting end of the overflow pipe of the present invention.
Figure 5:
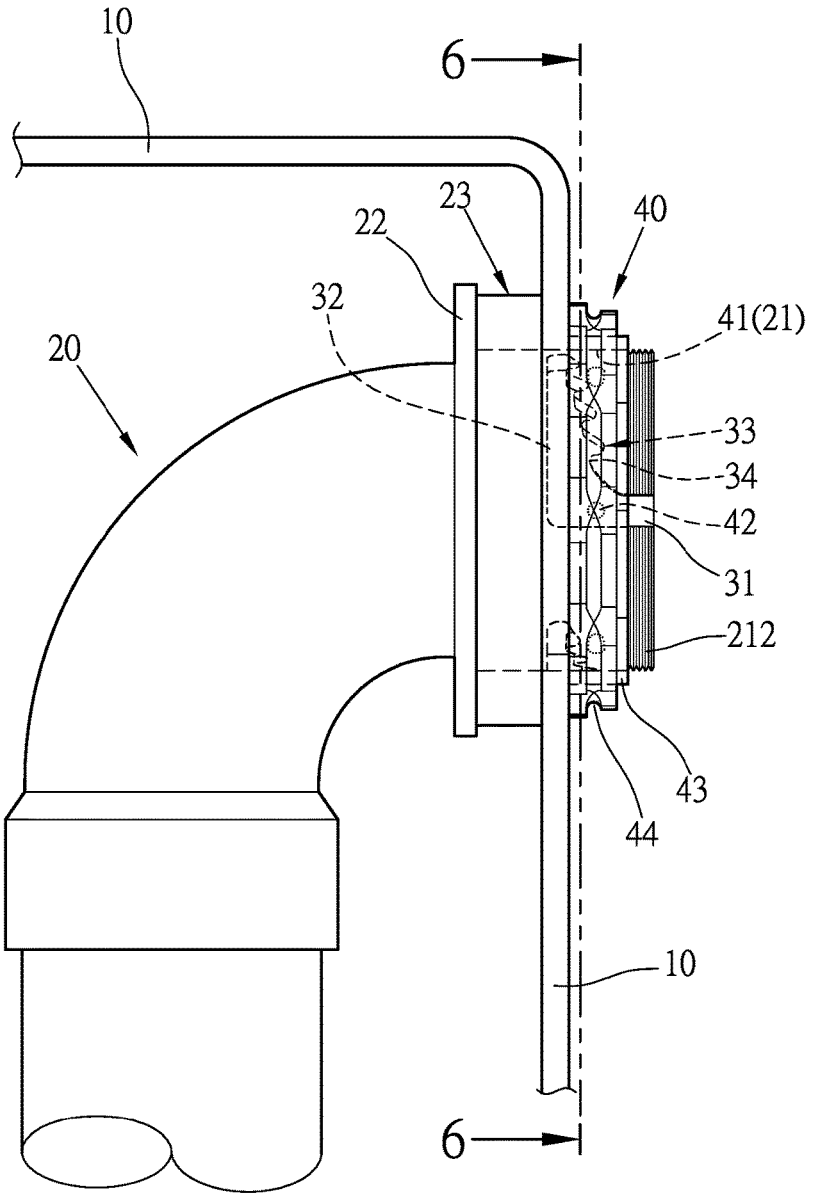
FIG. 5 illustrates that the collar is connected to the mounting end of the overflow pipe of the present invention.
Figure 6:
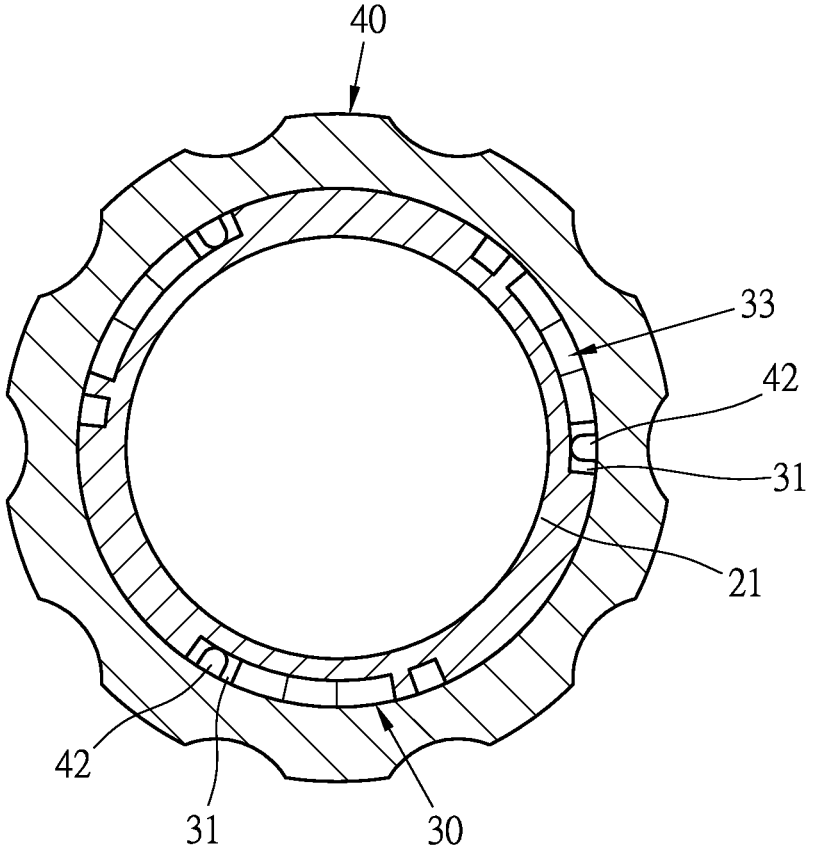
FIG. 6 is an end cross sectional view to show that the collar is mounted to the mounting end.

As shown in FIGS. 4 to 6, the collar 40 is then mounted to the mounting end 21, and the protrusion 42 is located in the opening 31 of the engaging portion 30. The collar 40 is then rotated to move forward and the protrusion 42 moves along the path 32. The cushion member 23 clamped between the flange 22 and the wall of the bathtub 10 absorbs vibration and force when the collar 40 moves forward such that the overflow pipe 20 is not moved inward relative to the bathtub 10.

Figure 7:
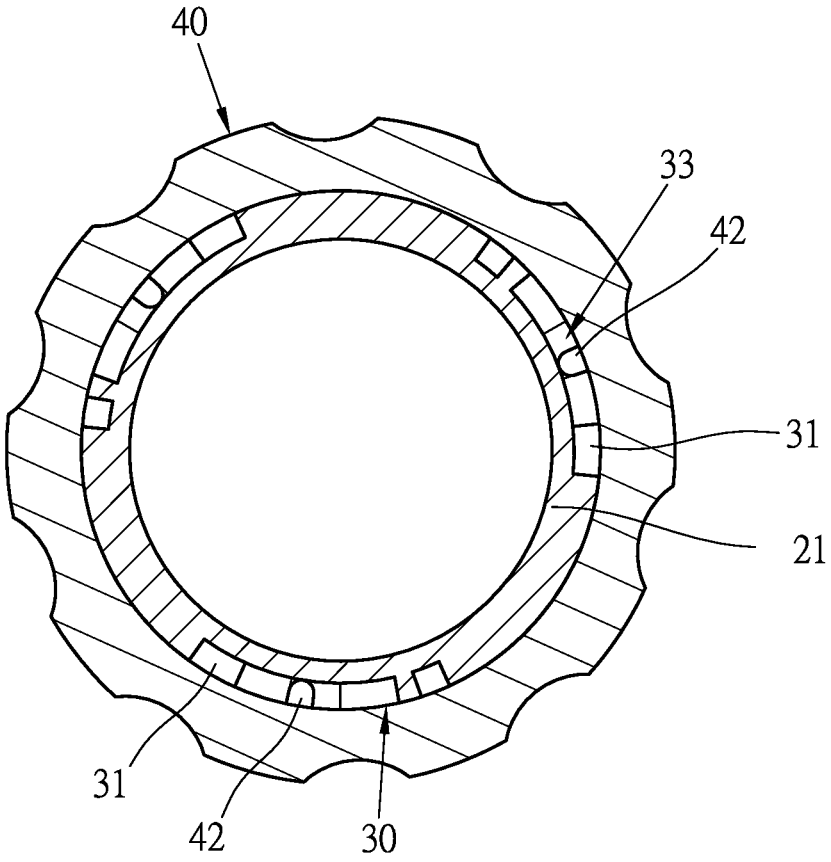
FIG. 7 is an end cross sectional view to show that the collar is rotated to engage the protrusion thereof with one of the teeth of the engaging portion of the mounting end.
Figure 8:
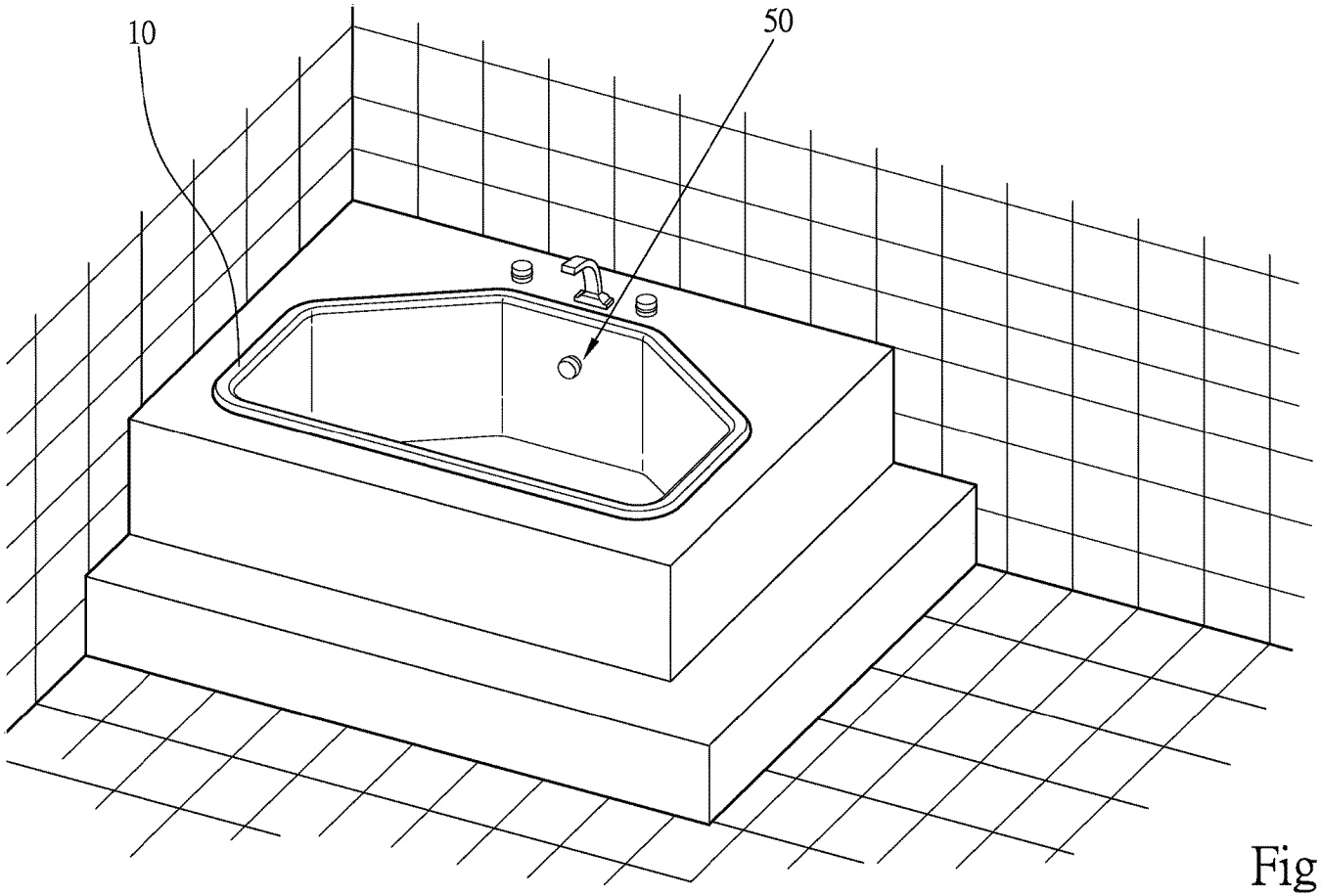
FIG. 8 shows that the bathtub having the overflow assembly of the present invention is installed in a bathroom.

As shown in FIGS. 2, 6 and 7, when the protrusion 42 moves to the bent portion of the path 23, the protrusion 42 moves into the path 23 while the collar 40 is rotated, and the protrusion 42 moves to the toothed section 33. Because the width of the path 23 between the tips and the first inside of the path 23 is varied, and the thickness of the wall of the bathtub 10 of different brands is different, so that when the collar 40 is moved to a position touching the wall of the bathtub 10, the protrusion 42 is engaged with the teeth 34 of the toothed section 33. The cap 50 is then mounted to the collar 40 and in contact with the O-ring 441 to seal the mounting end 21 of the overflow pipe 20, as shown in FIGS. 3 and 8.

When the users want to remove the collar 40, the cap 50 is pulled off from the collar 40, and the collar 40 is rotated in the reverse direction. The protrusion 42 is disengaged from the teeth 34 and moves along the path 32 until the protrusion 42 is released from the opening 31, so that the collar 40 is removed from the mounting end 21.

While we have shown and described the embodiment in accordance with the present invention, it should be clear to those skilled in the art that further embodiments may be made without departing from the scope of the present invention.

What is claimed is:

1. An overflow assembly comprising:

an overflow pipe having a mounting end, a flange extending outward from an outer periphery of the mounting end of the overflow pipe, the flange having an outer diameter being larger than that of the mounting end, a cushion member mounted to the mounting end, an outer diameter of the cushion member being smaller than the outer diameter of the flange, the cushion member being clamped between the flange and a wall of a bathtub;

the mounting end extending beyond an inside of the wall of the bathtub, multiple engaging portions defined in an outer periphery of the mounting end extending beyond the inside of the wall of the bathtub, each engaging portion having an opening and a toothed section, the opening communicating to a distal end of the mounting end and communicating with an L-shaped path which has an even width and turns an angle, the path having a first inside and a second inside which is located closer than the first inside to a distal end of the mounting end, the toothed section defined in the second inside of the path and having multiple teeth, a width between respective tips of the teeth and the first inside of the path being reduced from the opening toward a close end of the path;

a collar rotatably mounted to the mounting end and having an inner periphery, a protrusion extending radially and inward from the inner periphery of the collar, the protrusion being capable of passing through the opening and engaged with the teeth, an O-ring axially mounted to the collar, and a cap mounted to an outer surface of the collar and the O-ring, the cap having an overflow aperture.

2. The overflow assembly as claimed in claim 1, wherein the mounting end horizontally extends beyond the inside of the wall of the bathtub, a passage is defined through the distal end of the mounting end and the overflow pipe, the passage communicates with the overflow aperture, the mounting end includes test threads defined in the outer periphery of the mounting end.

3. The overflow assembly as claimed in claim 1, wherein the collar includes a driving portion defined in an outer periphery thereof, the driving portion is adapted to be secured by a tool.

4. The overflow assembly as claimed in claim 1, wherein the collar has a groove defined in the outer periphery thereof, the O-ring is engaged with the groove.

* * * * *